US005882269A

United States Patent [19]

Lewis

[11] Patent Number: 5,882,269

[45] **Date of Patent: *Mar. 16, 1999**

[54] STATISTICAL ANALYSIS AND FEEDBACK SYSTEM FOR SPORTS EMPLOYING A PROJECTILE

[76] Inventor: Robert D Lewis, 2410 Rusk St., Beaumont, Tex. 77702

[ * ] Notice: The term of this patent shall not extend beyond the expiration date of Pat. No. 5,645,499.

[21] Appl. No.: 888,579

[22] Filed: Jul. 7, 1997

Related U.S. Application Data

[63] Continuation-in-part of Ser. No. 543,369, Oct. 16, 1995, Pat. No. 5,645,499.

[51] Int. Cl.[6] ..... A63B 67/02

[52] U.S. Cl. ..... 473/407; 434/252

[58] Field of Search ..... 473/407, 150, 473/168, 169, DIG. 26; 434/252

[56] References Cited

U.S. PATENT DOCUMENTS

| | | | |
|---|---|---|---|
| 3,552,290 | 1/1971 | Brechtel | 473/407 |
| 3,949,987 | 4/1976 | Candor | 473/407 |
| 4,655,451 | 4/1987 | Townsley | 473/407 |
| 4,666,157 | 5/1987 | Bodine et al. | 473/407 |
| 4,783,071 | 11/1988 | Tattershall | 473/407 |
| 5,558,333 | 9/1996 | Kelson et al. | 473/407 |
| 5,645,499 | 7/1997 | Lewis | 473/407 |

*Primary Examiner*—Steven Wong

*Attorney, Agent, or Firm*—Joseph T. Regard, Ltd.

[57] ABSTRACT

A sports practicing aid and its method of use which includes graphic indicia in the form of a diagrammatic depiction of a typical golfing hole to be used at a driving range or other practice area which is employed by its user for recording thereon the user's shot pattern established during the course of making various actual practice shots. The aid further includes directions for its use and a system for shot statistical tabulation configured to allow the user to summarize the user's performance in terms of shot quality, in such a manner as to allow the golfer to identify and correct errors in his golf game (swing, grip, etc.). In the preferred embodiment of the present invention, practice materials are provided in consisting of a multitude of golf hole diagrams and attendant statistical tabulations. Basic golfing tips may also be included. While the preferred embodiment of the invention contemplates the present system in the form of a booklet, an alternative embodiment of the present invention contemplates the utilization of a computer or personal data assistant (PDA) having a screen, which computer of PDA is programmed with a diagrammatical layout of a practice area, upon which the user may record the user's shot pattern during practice sessions. The alternative embodiment of the present invention further contemplates a menu function wherein the user may consult an instructional database regarding golfing technique, historical data on past performance, transmittal functions, and programming functions including statistical manipulation of the shot data entered therein by the user for feedback, comparision, and historical use.

19 Claims, 7 Drawing Sheets

*THE PURPOSE OF THE BALLMARK™ PAD IS TO ASSIST THE GOLFER IN HITTING THE BALL STRAIGHTER AND MORE ACCURATELY BY CHARTING EACH PRACTICE SHOT AND BASED UPON BALL LOCATION, TO SPOT PROBLEM AREAS AND MAKE CORRECTIONS. THE PAD WILL ALSO SLOW YOUR PRACTICE A LITTLE, TENDING TO INCREASE YOUR FOCUS ON EACH SHOT AND LEAD TO A MORE PRODUCTIVE SESSION.*

DIRECTIONS

1. FILL OUT ALL INFO AT TOP OF PRACTICE SHEET– DATE, WEATHER, WIND, CLUB, ETC.
2. THE WATER HAZARD, BUNKER, TREES AND SHADED AREAS ON THE LEFT AND RIGHT SIDE OF THE FAIRWAY/GREEN ARE OUT OF BOUNDS. CONCENTRATE ON STAYING OUT OF THESE AREAS (STILL—BE SURE TO MARK YOUR SHOTS THAT GO THERE).
3. AT YOUR DRIVING RANGE OR PRACTICE AREA, SELECT TARGET OR AREA OF KNOWN DISTANCE AND HAVE THAT CORRESPOND TO THE PRIMARY TARGET (⊗) ON THE PRACTICE SHEET. THE PRIMARY TARGET IS CENTERED WITHIN THE SECONDARY TARGETS ( ) AND CAN BE ANY DISTANCE RELATIVE TO YOUR CLUB, YOUR POWER AND TYPE OF SHOT YOU ARE MAKING (I.E. 250± YARDS WITH A DRIVER).
4. THE RECTANGULAR SECONDARY TARGET SURROUNDING THE PRIMARY TARGET CAN BE USED FOR LONGER FAIRWAY OR TEE SHOTS. IT CAN BE ANY DIMENSION YOU DESIRE—SAY 40-45 YARDS WIDE AND 15-20 YARDS DEEP MIGHT BE GOOD WITH A FAIRWAY WIDTH OF 45-50 YARDS. A GOOD LONG TEE SHOT WOULD GO INTO THIS AREA, WITH GREAT SHOTS GOING ON THE HIGH SIDE OR BEYOND AND GOOD SHOTS MARKED ON THE LOW SIDE OR JUST BELOW.
5. THE CIRCULAR SECONDARY TARGET AREA, ALSO SURROUNDING THE PRIMARY TARGET, CAN BE A GREEN ABOUT 25-30 YARDS IN DIAMETER. YOU CAN HIT TO THIS AREA WITH ANY CLUB, BUT IT MIGHT BE PARTICULARLY GOOD FOR MOST IRONS, CHIP SHOTS, ETC. IF YOU DESIRE, MARK YOUR OWN CUP, CHANGE THE SHAPE OF THE GREEN OR ADD A BUNKER OR OTHER HAZARD TO FIT YOUR CONDITIONS.
6. THE NEXT PAGE IS A SAMPLE SHEET SHOWING 100 BALLS HIT TO A GREEN WITH A 5 IRON WITH A PRIMARY TARGET 160 YARDS DISTANT. REMEMBER TO SET THIS DISTANCE ACCORDING TO YOUR PERSONAL REQUIREMENTS.
7. THE REVERSE OF EACH SHEET HAS THE STATISTICAL BREAKDOWN OF YOUR PRACTICE SESSION. IT'S ALSO USEFUL IF YOU WANT TO KEEP UP WITH PERCENTAGES.

GOOD LUCK!

8. THE PAGES FOLLOWING THE SAMPLE SHEET INCLUDE A VERY GOOD LESSON THAT REVIEWS CRITICAL FUNDAMENTALS AND HAS THE NINE PRIMARY BALL FLIGHTS WITH APPROPRIATE CAUSE FOR THAT PARTICULAR FLIGHT. STUDY THIS – IT IS VERY USEFUL IN UNDERSTANDING AND CORRECTING ERRORS IN YOUR SHOT.

REMEMBER – THIS IS A GOOD GENERAL GUIDE FOR PRACTICE – FEEL FREE TO MAKE ANY ALTERATIONS TO FIT YOUR NEEDS.

FIGURE 2

FIGURE 3

YOUR STATS. . .

1. TOTAL NUMBER OF BALLS HIT . . . . . _____

2. NUMBER OF BALLS IN TARGET AREA
   OR THAT YOU CONSIDER GOOD . . . . . _____
   *PERCENTAGE OF GOOD SHOTS*
   *(NO. 2 ÷ NO. 1)* . . . . . _____

3. NUMBER OF POOR SHOTS:

A. OUT OF BOUNDS LEFT . . . . . _____
   *PERCENTAGE LEFT (NO. 3A ÷ NO. 1)* . . . . _____

B. OUT OF BOUNDS RIGHT . . . . . _____
   *PERCENTAGE RIGHT (No. 3A ÷ NO. 1)* . . _____

C. FAT SHOTS . . . . . _____
   *PERCENTAGE FAT (NO. 3C ÷ NO. 1)* . . . _____

D. THIN SHOTS . . . . . _____
   *PERCENTAGE THIN (NO. 3D ÷ NO. 1)* _____

*E. ANY OTHER POOR SHOTS* . . . . . _____
   *PERCENTAGE OTHER (NO. 3D ÷ NO. 1)* _____
   *F. TOTAL POOR SHOTS* . . . . . _____
   *PERCENTAGE TOTAL POOR SHOTS*
   *(TOTAL POOR ÷ NO. 1)* . . . . . _____

*THINK POSITIVE ON THESE STATS, CONCENTRATE ON YOUR GAME AND INCREASE THE PERCENTAGE OF YOUR GOOD SHOTS.*

*PRACTICE NOTES:*

STATISTICAL ANALYSIS AND FEEDBACK SYSTEM FOR SPORTS EMPLOYING A PROJECTILE

STATEMENT OF CONTINUING APPLICATIONS

The present application is a continuation-in-part of Ser. No. 543,369, now U.S. Pat. No. 5,645,499, filed Oct. 16, 1995 and issued Jul. 8, 1997, entitled "Golfwrite Statistical Analysis", listing as inventor Bob Louis.

FIELD OF THE INVENTION

The present invention relates to sports instructional systems, and in particular to a golf practicing, aid and its method of use which includes graphic indicia in the form of a diagrammatic depiction of a typical golfing hole to be used at a driving range or other practice area which is employed by its user for recording thereon the user's shot pattern established during the course of making various actual practice shots.

The present invention further includes a system for shot statistical tabulation configured to allow the user to summarize the user's performance in terms of shot quality, in such a manner as to allow the golfer to identify and correct errors in his golf game (swing, grip, etc.).

In the preferred embodiment of the present invention, contemplating a markable substrate in booklet form, practice materials are provided in consisting of at least one golf hole diagram and attendant statistical tabulations. Basic golfing tips may also be included.

While the preferred embodiment of the invention contemplates the present system in the form of a booklet, an alternative embodiment of the present invention contemplates the utilization of a personal data assistant (PDA) having a memory, a CPU, and a screen, which PDA is programmed with a diagrammatical layout of a practice area, upon which the user may record the user's shot pattern during practice sessions.

The alternative embodiment of the present invention further contemplates a menu function wherein the user may consult an instructional database regarding golfing technique, historical data on past performance, transmittal functions, and programming functions including statistical manipulation of the shot data entered therein by the user for feedback, comparison, and historical use.

The alternative embodiment of the present invention automates the statistical analysis of the user's shot pattern, providing instructional feedback, statistical data on swing patterns, and means to archive performance into memory for historical recordation and retrieval for later use and analysis, including discerning further patterns as well as improvement or decline in performance.

While the present invention is contemplated primarily for utilization with Golf, it is noted that the system is likewise suitable for utilization with other diverse sports employing a projectile, including, for example, tennis, billiards, horseshoes, football, baseball, hockey, soccer, rugby, cricket, basketball, and the like.

BACKGROUND OF THE INVENTION

The game of golf is a very popular and demanding sport. Since it is a sport that can be played individually, and can be especially practiced individually, it is popular among participants of all ages in many places throughout the world. The sport attracts many people because at first blush, it appears to be a relatively easy sport. However, upon closer inspection and actual participation, it does not take long to realize that it is a difficult sport to master, and needless to say, practice is essential in order to become even an accomplished golfer.

Without practice, the sport can become extremely frustrating and aggravating. For that reason, considerable books and practice aids have been introduced in the sport to aid golfers in perfecting their game. However, no product is known to exist that allows the golfer to record a series of practice shots with any given club and in any given practice area in order to identify any errors in the golfer's game.

Practice or study aids that require the participant to think about and evaluate some or the more important parameters that must be coordinated on each type of shot have been found to be especially useful, particularly for the less experienced golfer, because it is difficult when first learning the game, or only sparingly playing the game, to remember all of the more basic parameters that must be coordinated for any given shot. For example, a player's stance, grip, ball position, and alignment, among other things, must be coordinated for each different type of shot.

Among the advantages and features of the present invention is that it allows a golfer to record his shot pattern for a particular series of shots whereby with any club and at any practice area he can concentrate on one phase of the game at a time, that is, making a particular shot, and concurrently record the results which he can then subsequently evaluate and analysis. That is, he need not attempt to perform all of these functions at once.

Among other advantages and features of the present invention is that it provides a means for rapid evaluation of the problems with the golfer's swing, stance, grip, etc. Moreover, the present aid allows Coaches or professional instructors to home in on a problem immediately. This allows an instructor/coach to be more effective in improving the students game more rapidly. Additionally, the present invention is adaptable to any practice area regarding distances, dimensions, conditions, and hazards as well as being adaptable to any golfing club.

The present golfing aid also allows an instructor or coach to examine the practice periods of students and their progress between practice sessions by having a written record that is a more accurate reflection of a particular student's game because it has occurred over a number of practice sessions. It can also be appreciated by one skilled in the art that the present aid is adaptable to every club and that the pad can be altered to fit a particular layout or hole design.

SUMMARY OF THE INVENTION

The preferred embodiment of the present invention comprises a golf practicing aid booklet or pad having a multitude of diagrammatical depictions of a hole or a part thereof of a typical golf course for use at a driving range facility or other practice area on which the user marks each practice shot the user takes towards some position or target on the hole, e.g. a position down the fairway or on a green. The present booklet or pad includes directions for its use, as well as a statistical tabulation sheet.

The statistical tabulation sheet of the preferred embodiment of the present invention allows the user to record the number of balls hit and to differentiate between good shots versus bad shots with the present golfing aid, the user can practice a specific type of shot, and record the results which are subsequently evaluated and analyzed by virtue of the recorded shot pattern.

The preferred embodiment of the invention further provides written golf instructions involving the more common golfing parameters that need be mastered in order to play the sport effectively, and in accordance with accepted form technique. The instructional information may be provided in the form of a separate, pocket sized reference pad, which would provide a summation of fundamentals on appropriate golf swing techniques and ball flight analysis.

A useful and effective alternative embodiment of the present invention contemplates the utilization of a computerized version of the present invention implementing, as an example, a personal data assistant (PDA) having a memory, a CPU, and a screen, which PDA is programmed with a diagrammatical layout of a practice area, upon which the user may record the user's shot pattern during practice sessions. An example of an off-the-shelf PDA which might be programmable to accomplish the functions of the present invention could be, for example, the PALM PILOT as manufactured by U.S. ROBOTICS of Mountain View, Calif. The PALM PILOT is only a hypothetical example of an appropriate computer which may be programmable to perform the functions of the present invention. Another example might include the CASIO brand WIZARD, or any INTEL brand PENTIUM based processor Laptop or other computer or the like.

Computers or PDA's would be programmed such that a graphical representation of a golf hole is portrayed thereon, such that the user could input the approximate location a struck ball on the screen as it relates to a target area. Computers or PDA's having a touch sensitive screen would allow direct input of the location of the struck ball by touching the screen in the approximate location of the ball as it relates to the target while other computers, without touch sensitive screens could be inputted with the approximate location of the struck ball via mouse, pointer, or X-Y coordinates via keyboard.

The approximate location of the a plurality of balls would be entered into the computer or PDA, and stored in memory, while illustrating same on the screen. The computer or PDA would be programmed to analyze some or all of the inputted locations statistically to discern patterns relating to ball flight analysis, including classifying patterns as likely having been struck utilizing proper techniques, or the possible presence of anomalies in the golf swing or striking of the ball, including, for example, improper gripping procedure, improper club face alignment to the ball at striking, improper body alignment, improper aim, improper contact with the ball, improper setup, ball flight analysis, etc.

The computer or PDA could be programmed to provide real time analysis, so that with input of the location of the struck ball relative to the target, observations as to the location of the ball, commentaries regarding same, and instructional tips can be indicated, or, the computer can be programmed to provide a summary, statistical information, observations, and instructional hints and commentary can be had after the user has completed the ball strike sequence.

The alternative embodiment of the present invention further contemplates a menu function wherein the user may consult an instructional database regarding golfing technique, historical data on past performance, transmittal functions (for transmitting the data to a separate computer for further use via RF, IR, cable, or modem, for example), and programming functions including statistical manipulation of the shot data entered therein by the user for feedback, comparison, and historical use.

The alternative embodiment of the present invention automates the statistical analysis of the user's shot pattern, providing instructional feedback, statistical data on swing patterns, and means to archive performance into memory for historical recordation and retrieval for later use and analysis, including discerning further patterns as well as improvement or decline in performance.

An additional feature of the present invention is that it instills in the user a step-by-step approach or methodology which trains or disciplines the user to become more thoughtful and analytical in the method of striking the ball, causing the practice session to be far more effective than the typical practice session.

A present objective of the invention is to provide the user a golf practicing device and apparatus which allows the user to record a multitude of different practice shots while concentrating on his swing whereby the shot pattern, established by virtue of the user's swing, can be recorded and subsequently evaluated and analyzed.

DESCRIPTION OF THE DRAWINGS

FIG. 2 of the drawings is a tabulation of the instructions for the use of the present golf practicing booklet of FIG. 1.

FIG. 3 of the drawings is a tabulation outline whereby the user can tabulate and calculate the percentage of good shots versus bad shots for use with the practicing booklet of FIG. 1.

DESCRIPTION OF THE PREFERRED EMBODIMENT

Figure 1:
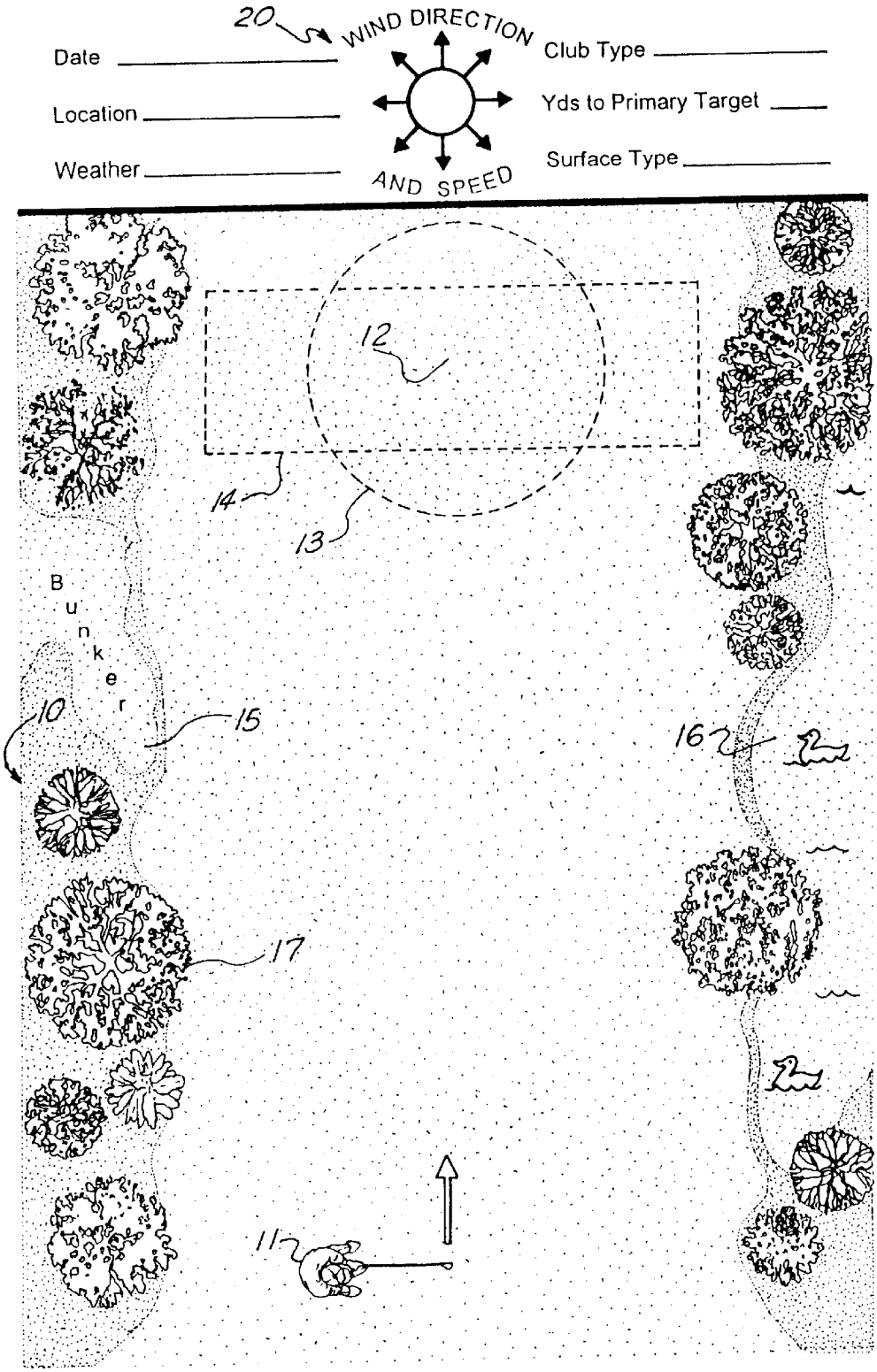
FIG. 1 of the drawings is a diagrammatical plan view of a typical fairway or green on a typical golf course to be used at a practice area showing the position of the user taking a shot toward a particular location or target on the hole on which graphic representation the user records various practice shots with a given club.

FIG. 1 of the drawings depicts the essential indicia of the preferred embodiment of the present invention, which in essence constitutes the graphic representation of a golf hole or a portion thereof, e.g., a fairway, green, cup or pin, or hazards of a typical golf course.

Reference numeral 10 of FIG. 1 represents a practice area which is a reproduction of a fairway or green forming part of a golf course. The user 11 is shown in position on the fairway or in a tee box making a shot toward the marked area that is an ideal location or target 12 which can either be a position on the fairway or the pin or cup on a green. This can comprise either the circular portion 13 which represents a green with 12 being the cup or pin or the rectangular portion 14 which represents an ideal area on the fairway. The golfer determines all of this by selecting objects or areas of known distance and size at his practice area.

The latter areas 13 and 14 can also be construed as a zone within which the user 11 is attempting to consistently hit a golf ball within, such as the good in-play area on a fairway that a tee shot or other fairway shot to the pin 12. The portion 10 of a golf hole includes various other graphic indicia typifying it as a golf hole or fairway, e.g. the bunker 15 on the left, the water hazard 16 on the right, and the various trees 17.

Of course, it can be appreciated by one skilled in the art that the portion 10 of the hole arrangement shown can be illustrated in different manners, e.g. a hole having a dog-leg to the left or right, or having a bunker 15 or a water hazard 16 immediately across the path of flight of the ball hit by the user 11 toward the spot or target 12, viz. it is adaptable to different layouts.

FIG. 1 further comprises the written indicia 20 above the portion 10 which allows the user to record the wind direction and speed, the date of the practice section, the practice site, the weather conditions, the type of club employed, the number of yards to the primary target 12 from the position of the user 11 shown in the portion 10, and the type of surface the practice shots were hit from or landing on.

FIG. 2 of the drawings is a tabulation of directions for utilizing the present golf practice booklet or pad. The directions in paragraphs 4 and 5 thereof describe the particular function of the indicated shot areas 13 and 14. The shot area in 13 would typically comprise a green about 25–30 yards in diameter which would be approached primarily with an iron. Whereas, the rectangular area 14 would typically be a target 40–45 yards wide and 15–20 yards deep laying on a fairway which typically would be approached with a wood club.

FIG. 3 of the drawings comprises a tabulation of the results of the user's shot pattern. For one, the user would record a total number of balls hit. In paragraph 2, the user would record the number or balls hit in a selected target area or that which the user considers to be good shots. By dividing the number of balls hit within the target area by the total number of balls hit, the user would arrive at the percentage of good shots. In paragraph 3, the various types of poor shots are recorded, specifically, in subparagraph A, the number of out of bound shots to the left; in subparagraph B, the number of out of bound shots to the right; in subparagraph C, the number of fat shots; in subparagraph D, the number of thin shots, and in subparagraph E, any other poor shots.

Of course, the percentage of each is derived as instructed in FIG. 3. The user would then total up the number of poor shots and calculate the number of poor shots taken.

As pointed out above, a distinct advantage of the present Invention is that the user can record a complete pattern of practice shots taken which can then subsequently be evaluated and analyzed.

In the meanwhile, the user can concentrate on the critical fundamentals that part time golfers or amateurs must do to play a decent round of golf Of course, someone who plays considerable golf, especially a professional, executes a lot of these fundamentals automatically without thinking about it.

On the other hand, an amateur must constantly review in his mind these fundamentals. The present invention allows the user to record various golf shots without trying to subsequently recall them from his memory and then analyze what he may have been doing wrong in making that particular shot.

The user can either take a multitude of practice shots employing what the user thinks is the manner of executing the critical fundamentals and thereafter subsequently review the recorded pattern of golf shots to determine what particular fundamental was not being employed or followed. Another distinct advantage of the present invention, is that it not only allows the user to record his pattern of practice shots and personally evaluate his performance at a later time, but additionally, gives him a recorded history of such shots which he can subsequently discuss with others, e.g. an instructor who would be able to shed some light on the user's problems.

Yet another advantage of the present invention is that every visual aid an amateur golfer can add to the perfection of his game generally makes it easier for the golfer to subsequently analyze and improve his game. Merely trying to go back and remember what you might have done wrong on a particular shot is extremely difficult, and in any event, makes its impossible to subsequently confer with an expert to ascertain exactly what you did do wrong on a particular shot. Thus, it becomes apparent that the present golfing aid is primarily designed for making a series of practice shots.

It would be apparent to one skilled in the art that many changes can be made to the basic inventive concept disclosed herein without departing from the true scope and spirit of the present invention. For example, the position of various hazards shown in FIG. 1 of the drawings can be varied as well as the target areas Additionally, the location of the written indicia portion 20 can be relocated.

Moreover, the instructions of FIG. 2 of the drawings can be varied. Additionally the statistical tabulation shown in FIG. 3 of the drawings can be varied without departing from the true scope and spirit of the present invention. Last but not least, as pointed out above, the present golf practice booklet or pad preferably includes, either as a single tablet or in the form of a separate, pocket sized booklet, a series of illustrated critical golf fundamentals as well as primary ball flights that occur depending upon variations in following such critical golf fundamentals. A set of causes accompanies each ball flight to explain to the user what fundamental may have been violated assuming said ball flight pattern was not desired to start with. A given ball flight that is not desired would depend upon violation of one or more critical fundamentals, such as grip, ball position, open stance, and so forth.

The preferred embodiment of the present invention comprises a pad of the present diagrammatical golf course hole arranged in a conventional stenographic size 6×10 inch wire bound booklet comprising a multitude of FIG. 1 diagrams with the FIG. 3 statistical tabulation printed on the back thereof The pad E would also preferably include the FIG. 2 instructions and a sample FIG. 1 shot pattern embodied on the first few pages followed by critical fundamental illustrations, such as grip, stance, and so forth and typical ball flight patterns following such fundamentals which precede a multitude of FIG. 1 printed and graphic indicia materials.

Referring now to FIGS. 4–7, the teachings of the present invention are not limited to tablet form, and may be employed electronically, providing an automated means of storing and calculating statistics, as well as providing access to database information in golfing techniques pertinent to improving performance, based upon analysis the user's golf shots.

A useful and effective alternative embodiment of the present invention contemplates the utilization of a computerized version of the present invention implementing, as an example, a personal data assistant (PDA) having a memory, a CPU, and a screen, which PDA is programmed with a diagrammatical layout of a practice area, upon which the user may record the user's shot pattern during practice sessions. An example of an off-the-shelf PDA which might be programmable to accomplish the functions of the present invention could be, for example, the PALM PILOT as manufactured by U.S. ROBOTICS of Mountain view, Calif. As earlier discussed, the PALM PILOT is only a hypothetical example of an appropriate computer which may be programmable to perform the functions of the present invention. Another example might include the CASIO brand WIZARD, or any INTEL brand PENTIUM based processor Laptop or other computer or the like, as well as a custom computer manufactured for the purpose of the present invention.

As shown, the alternative embodiment of the present invention is in the form of a computer having data entry means in the form of a touch sensitive screen, mouse, keyboard, or the like, a CPU 110 (which communicates with a display or screen 100 via display interface 112 or the like), and memory 111. The present system may comprise, for example, a portable computer or personal digital assistant or PDA, such as the unit shown in FIG. 4. As shown the PDA 101 includes a screen 100 which preferably is touch sensitive, wherein data entry may be accomplished by stylus 102. The PDA has stored in memory a program for ball flight analysis, such that the user may initiate same by powering on the unit via power button 103, logging on the unit, thereby identifying the user to the system and initiating said program from a list of programs on the unit.

The present invention contemplates a menu function wherein the user may consult an instructional database regarding golfing technique, historical data on past performance, transmittal functions (for transmitting the data to a separate computer for further use via RF, IR, cable, or modem, for example), and programming functions including statistical manipulation of the shot data entered therein by the user for feedback, comparison, and historical use.

Figure 4:
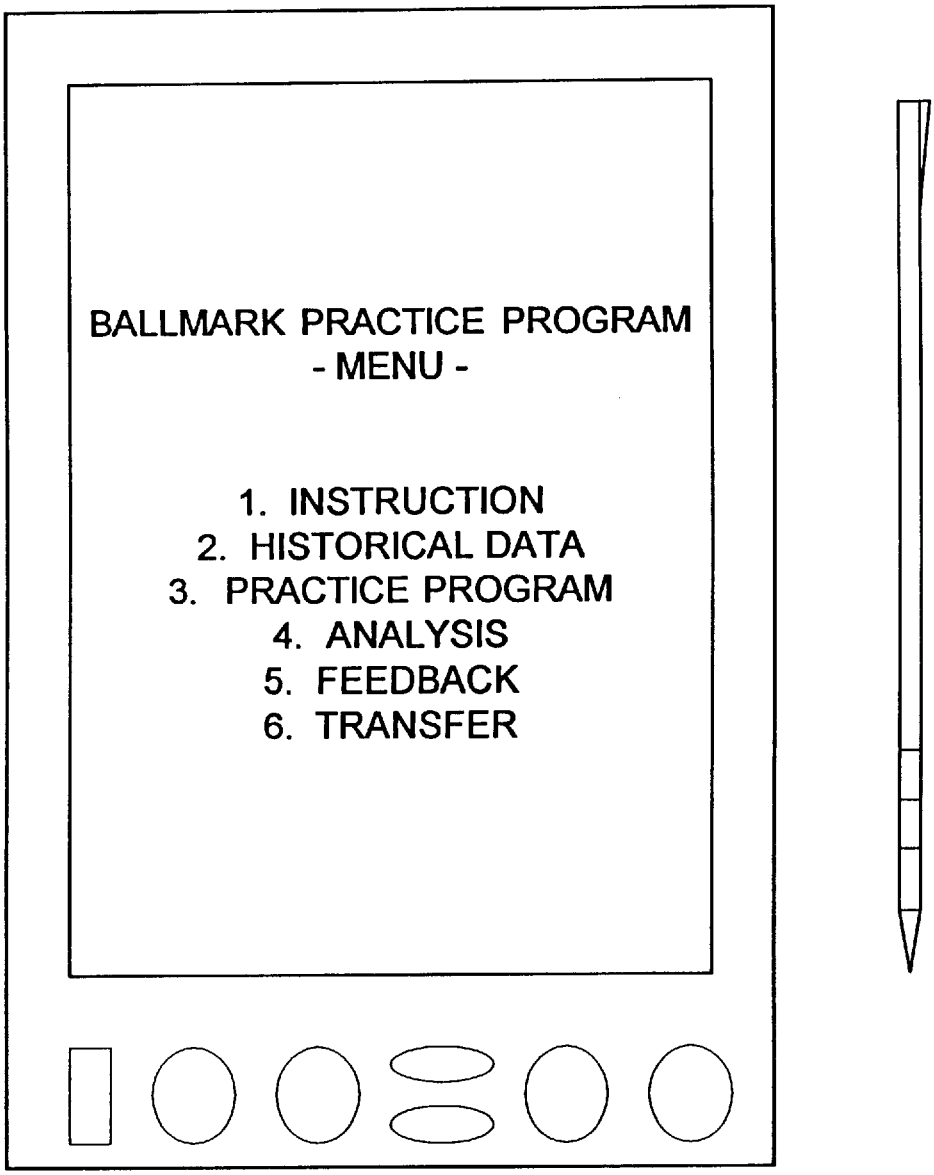
FIG. 4 of the drawings illustrates a frontal view of an alternative embodiment to the invention of FIG. 1, illustrating a computerized system for recording and disseminating user performance data, illustrating a menu of alternative programs available.

An exemplary menu for a ball flight program, which may be amongst those programs on the unit, is indicated on the screen 100 of the unit in FIG. 4, entitled, for example, "Ballmark Practice Program", including as choices "Instruction" 104, which may include selected golf techniques for improving form or performance, and may be tailored by the unit to enhance perceived weaknesses in the users performance, which user the unit has become aware due to the user's logging on to the unit.

Another category which may be included is "Historical Data" 105, which may include, for example information stored on past performance of the user, including completed practice sessions, statistical data and summaries.

A third category which preferably would be found is the "Practice Program", which would allow the user to practice golf strokes and enter the results directly into the unit for recordation, analysis, and feedback. In initiating such a program, the user would generally be questioned as to certain environmental factors regarding the practice area, including, for example, wind direction and speed, the date of the practice section, the practice site, the weather conditions, the type of club employed, the number of yards to the primary target from the position of the user, and the type of surface the practice shots were hit from or landing on. Other factors may include, for example, the slope of the practice surface, the presence of precipitation, the type of ball utilized, whether this was a day or night session, the time, etc. It is noted that the sequence for entering the environmental criteria is a programming choice, and said criteria may be entered before the practice session, and said criteria may be a part of the practice screen having the.

Figure 5:
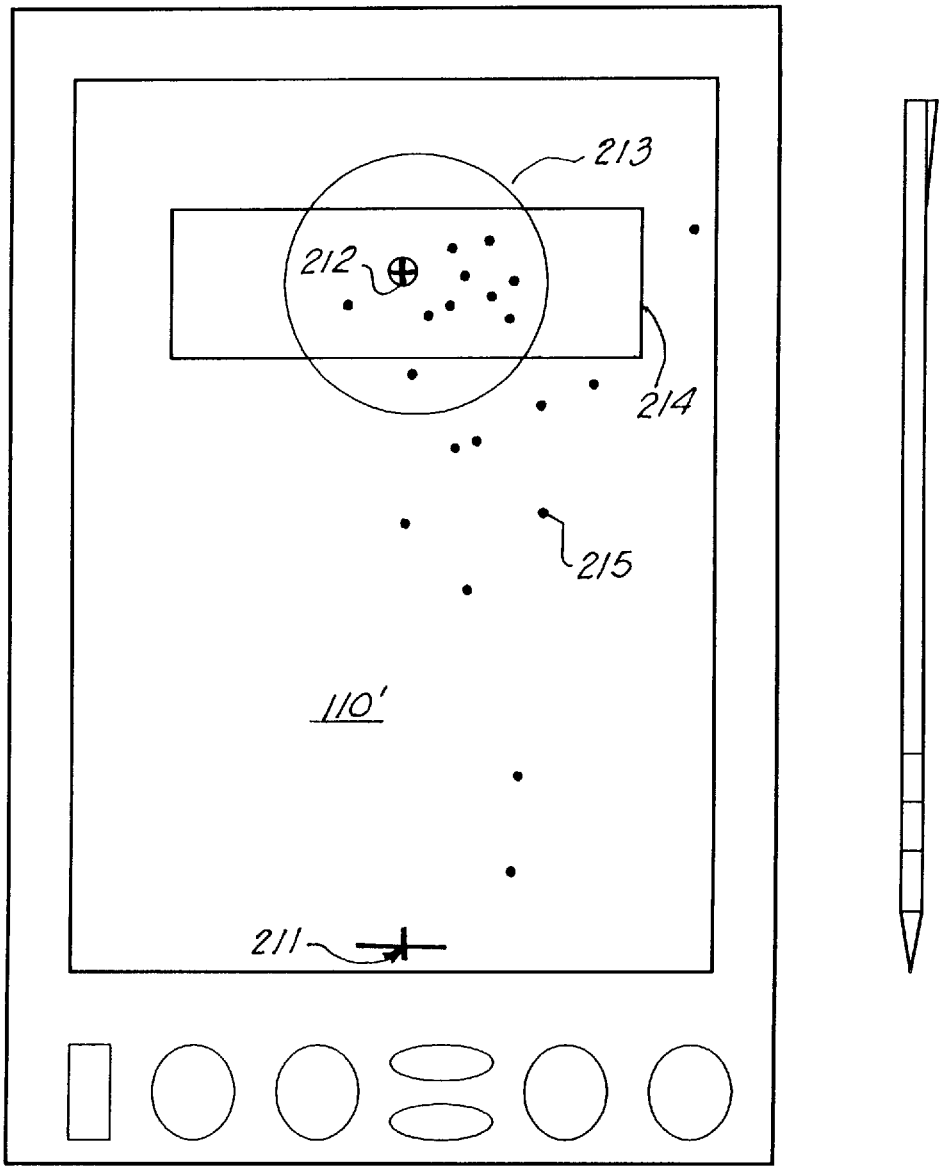
FIG. 5 illustrates a frontal view of the invention of FIG. 4, illustrating an exemplary diagrammatical layout of a typical fairway and green, further illustrating an approximate position of the user taking a shot at a target location, as well as exemplary markings thereon signifying struck golf ball locations relative to the target area during a golf session, as approximated by the user.

Referring to FIG. 5, the unit is employed during a practice session in much the same way as the preferred, booklet form of the invention of FIGS. 1–3, with the display screen forming the markable substrate via stylus or the like, or other alternative forms of data input as earlier mentioned.

As shown, the practice program segment of the present invention includes the on-screen depiction of a approximated graphical representation of a golf hole or a portion thereof, e.g., a fairway, green, cup or pin, or hazards of a typical golf course, which approximation can be that of the actual practice area, or an imaginary hole layout employed and visualized during the user during the practice session.

As indicated in FIG. 5, the exemplary practice area 110' may be in the form of an imaginary or actual, approximated reproduction of a fairway or green forming part of a golf course. The user 211 is symbolically shown in position on the fairway or in a tee box aligned to make a shot toward the marked area that is an ideal location or target 212 which can either be a position on the fairway or the pin or cup on a green. This can comprise either the circular portion 213 which represents a green with 212 being the cup or pin or the rectangular portion 214 which represents an ideal area on the fairway. The golfer determines all of this by selecting objects or areas of known distance and size at his practice area. The latter areas 213 and 214 can also be construed as a zone within which the user 211 is attempting to consistently hit a golf ball within, such as the good in-play area on a fairway that a tee shot or other fairway shot to the pin 212. The portion 110' of a golf hole may include various other graphic indicia typifying it as a golf hole or fairway, e.g. the bunker on the left, for example, a water hazard, and/or various trees.

Of course, it can be appreciated by one skilled in the art that the portion 110' of the hole arrangement shown can be illustrated in different manners, e.g. a hole having a dog-leg to the left or right, or having a bunker or a water hazard immediately across the path of flight of the ball hit by the user toward the spot or target, viz. it is adaptable to different layouts.

Also, the hole arrangement can easily be rendered to approximate golf course layouts, wherein the user may actually be present on said course and utilize the present system to record shots for real time statistical information and instructional feedback, or may utilize said actual courses in visualizing a virtual golf session in a practice area, field, or other golf course.

Further, the present system may be utilized not only for practicing tee-offs and fairway shots, but may also be utilized for practicing chips and putting on the green in the same manner as taught herein.

In use, as indicated, the unit of the alternative embodiment of the present invention would be programmed such that a graphical representation of a golf hole is portrayed thereon, such that the user could input the approximate location a struck ball on the screen as it relates to a target area. The preferred, alternative embodiment of the present invention includes a touch sensitive screen which would, via stylus, pen, user's finger, or other instrument would allow direct input of the location of the struck ball by touching the screen in the approximate location of the ball as it relates to the target while other computers, without touch sensitive screens could be inputted with the approximate location of the struck ball via mouse, pointer, or X-Y coordinates via keyboard.

The approximate location of the a plurality of balls would be entered into the unit, and stored in memory, while illustrating same on the screen.

Figure 6:
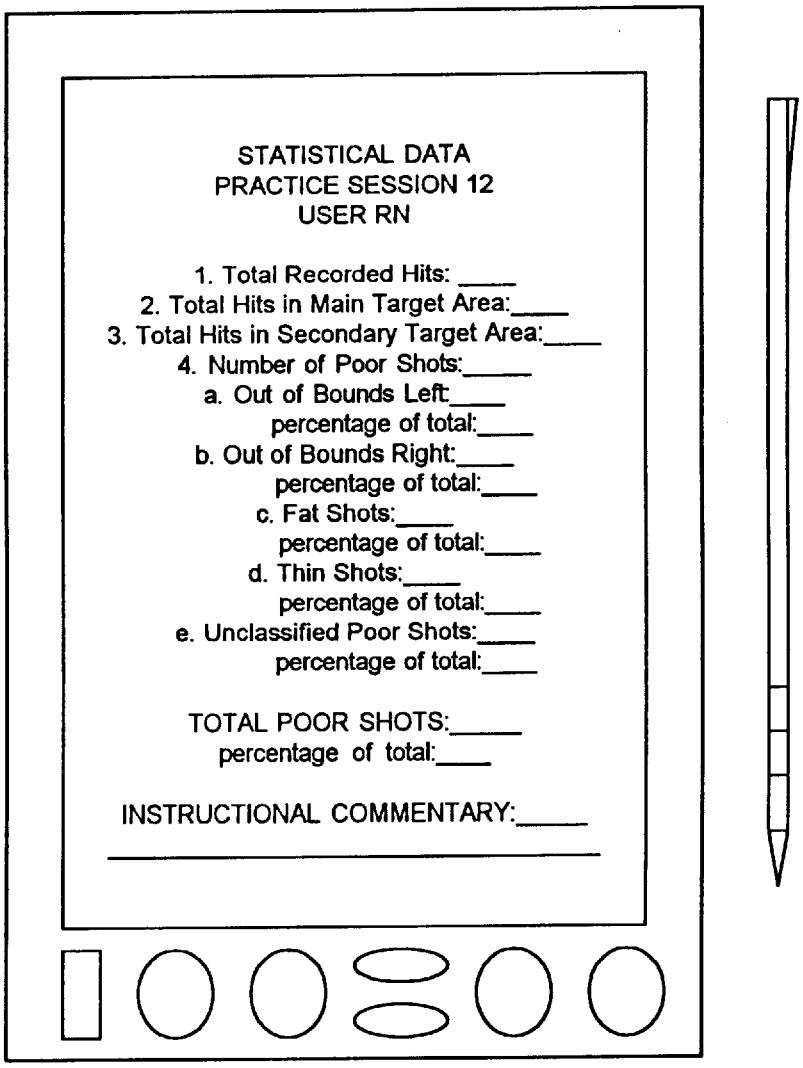
FIG. 6 illustrates a frontal view of an exemplary statistical data table, illustrating statistical information which may be calculated by the computer based upon data entry by the user regarding struck ball locations relative to the target area during a session, as well as other pertinent information including instructional commentary and pertinent comment made by the computer in response to statistical information regarding shot percentages.
Figure 7:
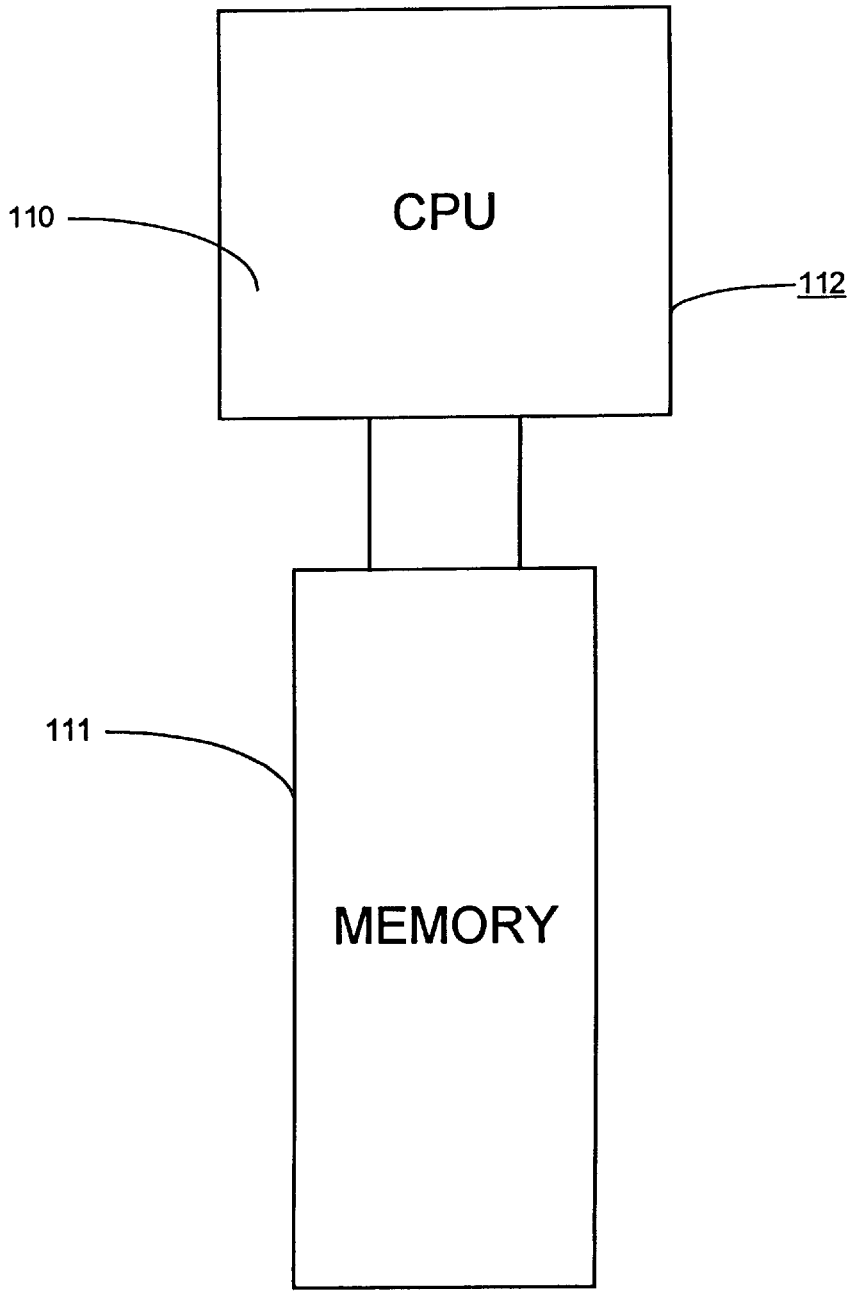
FIG. 7 illustrates an example of a basic schematic of a CPU and Memory, comprising main hardware components of a computer or PDA as may be utilized in the alternative embodiment of the invention of FIG. 4.

Referring to FIG. 6, the unit could be programmed to analyze some or all of the inputted locations statistically to discern patterns relating to ball flight analysis, including classifying patterns as likely having been struck utilizing proper techniques, or the possible presence of anomalies in the golf swing or striking of the ball, including, for example, improper gripping procedure, improper club face alignment to the ball at striking, improper body alignment, improper aim, improper contact with the ball, improper setup, ball flight analysis, etc.

As shown a tabulation of the results of the user's shot pattern is calculated and displayed based upon the user's environmental data input and input regarding the end location of the struck golf balls, as depicted in FIG. 5.

As an example, first indicated is the total number of balls hit, next the number or balls hit in a selected target area or that which is within the target area by the total number of balls "good shot". By dividing the number of balls hit within the target area by the total number of balls hit, the program would arrive at the percentage of good shots.

Next, various classifications of poor shots are indicated, specifically, including, for example, the number of out of bound shots to the left; the number of out of bound shots to the right, the number of fat shots; the number of thin shots, and any other poor shots.

The computer or PDA could be programmed to provide real time analysis, so that with input of the location of the struck ball relative to the target, observations as to the location of the ball, commentaries regarding same, and instructional tips can be indicated, or, the computer can be programmed to provide a summary, statistical information, observations, and instructional hints and commentary can be had after the user has completed the ball strike sequence.

Lastly, based upon patterns in the statistical data, such as, for example, a high percentage of "Out of bounds right", the computer may refer to an golf instructional database to discern possible causes for such ball flights, and display commentary on same with instruction and hints.

Thereby, the present invention automates the statistical analysis of the user's shot pattern, providing instructional feedback, statistical data on swing patterns, and means to archive performance into memory for historical recordation and retrieval for later use and analysis, including discerning further patterns as well as improvement or decline in performance.

Thusly, the alternative embodiment of the present invention provides the user with a golf practicing device and apparatus which allows the user to record a multitude of different practice shots while concentrating on his swing whereby the shot pattern, established by virtue of the user's swing, can be recorded and subsequently evaluated and analyzed.

Thus, in summary, the alternative embodiment of the present invention comprises a markable substrate or screen depicting a diagrammatical layout of a golf hole including hazards graphically depicted thereon, on which substrate a user can mark practice golf shots with reference to a target area graphically depicted thereon, providing golf shot indicia 215, The present invention further comprises a statistical tabulation means for analyzing said golf shot indicia, discerning the location of at least some of said golf shots and discerning the number of golf shots within said target area and the number of golf shots outside of said target area, as well as the relative location of said golf shots relative to said target area, said statistical tabulation means in the form of a microprocessor or CPU driven program, and further including analyzation means for discerning patterns relative to the location of said golf shots relative to said target area, providing the categorizing at least some of said golf shots based upon the relative location of said golf shots, in order to discern particular areas of weakness in said users golf swing.

As indicated, the "markable substrate" could comprise a display, which may be touch sensitive.

The memory of the present system provides a data storage means, said data storage means having stored thereon golf instructional data, although a hard drive or other data storage system may also be implemented.

The present system may further include in the program a golf instructional database, as well as analyzation of the statistical information do discern in the users golf swing, said feedback means including communicating to said user selected golf instructional data to improve said discerned weakness in said users golf swing.

An exemplary method of aiding a user in developing a golf swing, utilizing the present system might comprise the steps of, for example:

a. providing a computer having a visual display depicting a diagrammatical layout of a golf hole including hazards graphically depicted thereon, on which a user can mark practice golf shots with reference to a target area graphically depicted thereon;

b. practicing striking golf balls at a target, comprising the further steps of:

i. striking a first golf ball at a target area having a target point;

ii. discerning the end location of said struck first golf ball relative to said target point, iii. visualizing said target point as said golf hole on said visual display of said computer, inputting into said computer the approximate location of said first golf ball relative to said target point, as depicted on said visual display;

iv. striking another golf ball at a target area having a target point;

v. discerning the end location of said other struck golf ball relative to said target point;

vi. visualizing said target point as said golf hole on said visual display of said computer, inputting into said computer the approximate location of said other golf ball relative to said target point, as depicted on said visual display;

vii. repeating steps iv—vi until the desired amount practice has been achieved, generating golf ball location data of each ball relative to said target point, forming a database of ball location data entries for a practice session;

c. statistically analyzing said database to discern patterns in said golf ball location data.

As indicated supra, the method of the present invention may provide the additional step of providing a database of golf instructional information including ball flight analysis, said database indexed according to the lie of a ball after a shot, and wherein there is further included after step "c" the additional step of utilizing said patterns in said golf location data to access instructional information on said database of golf instructional information, thereby improving upon said user's golf swing. It is further reiterated that the present system may be utilized for recording golf tee-offs, swings on a fairway, chips, putts, or virtually any club or type of swing, as well as approximating a variety of environmental target and location layouts.

While the present invention is contemplated primarily for utilization with Golf, it is noted that the system is likewise suitable for utilization with other diverse sports employing a projectile, including, for example, tennis, billiards, horseshoes, football, baseball, hockey, soccer, rugby, cricket, basketball, riflery and the like. In the case of golf, the projectile, a golf ball, is "launched" via striking same with a club face. With billiards, the billiards ball the projectile, which is struck with a cue, with horseshoes, the projectile is a horseshoe launched with the hand towards the target area, i.e., a rod protruding from the ground; in hockey, the projectile is a puck, which is launched via hockey stick; in basketball, the ball is the projectile which is launched via the hands of the user; in soccer, the ball is launched with the feet, in cricket and baseball, the ball is launched with the bat, in riflery, the projectile is a bullet launched with a gun at a target which may be a paper bulls-eye.

In each of the above examples, one can benefit from practice sessions whereby strikes the projectile towards the target area, observes where it lands, and recording same; also, in each of the above categories, the compiled data on the locations of the projectiles can be analyzed for patterns, a database consulted to discern likely causes of said patterns, and instructional information or hints displayed by the unit to the user for correcting improper form.

In light of the above, it can be appreciated by one skilled in the art that many varying different embodiments can be made within the scope of the present inventive concept, and accordingly, it is be understood that the details of the present concept are to be 5 interpreted as illustrative and not in a limiting sense. Therefore, what is intended to be encompassed within the ambit of the present invention is that as set forth and particularly pointed out in the appended claims.

What is claimed is:

1. Golf practicing aid means for aiding a user in developing a golf swing, comprising:

a markable substrate depicting a diagrammatical layout of a golf hole graphically depicted thereon, on which substrate a user can mark a plurality of like, repeated practice golf shots originating from a generally fixed location with reference to a target area graphically depicted thereon, with golf shots situated within said target area defining good golf shots, and said golf shots situated outside of said target area defining bad golf shots, said golf practicing aid means further comprising a statistical tabulation markable substrate on which the user inscribes the number of good shots within said target area and the number of poor shots outside of said target area, whereby the user can then calculate the percentage of good shots versus poor shots, said statistical tabulation markable substrate further comprising poor shot indicia, setting forth a breakdown of categories of poor shot types selected from a listing of said types, said poor shot indicia arranged to enable a user to indicate on said statistical tabulation markable substrate the number of poor shots in each of said categories, and thereby discern particular areas of weakness in said users golf swing.

2. The golf practicing aid means of claim 1 further characterized in that a multitude of markable substrates are combined in the form of booklet means.

3. The golf practicing aid means of claim 2 further characterized in that said booklet means includes illustrated critical fundamental golfing instructions.

4. The golf practicing aid means of claim 3 further characterized in that said booklet means includes illustrated ball flight analyses.

5. The golf practicing aid means of claim 1 further characterized in that said markable substrate is further defined as depicting a target area comprising a rectangular area having a specific target point therein and a circular area superimposed thereon representing a green whereby the specific target point represents a pin so that the user can record either practice fairway shots or green shots.

6. The golf practicing aid means of claim 1 further characterized in that said markable substrate is further defined as having a portion thereon for recording pertinent information selected from the group consisting of the date, location, weather, wind direction, club type, yards to primary target, and surface type.

7. The method of aiding a user in developing a golf swing, comprising the steps of:

a. providing in booklet form, a markable substrate depicting a diagrammatical layout of a golf hole including hazards graphically depicted thereon, on which substrate a user can mark practice golf shots with reference to a target area graphically depicted thereon said golf practicing aid means further comprising a statistical tabulation markable substrate on which the user inscribes the number of good shots within a target area and the number of poor shots, whereby the user can then calculate the percentage of good shots versus poor shots, said statistical tabulation markable substrate further comprising poor shot indicia, setting forth a breakdown of at least two categories of poor shots, said poor shot indicia arranged to enable a user to indicate on said statistical tabulation markable substrate the number of poor shots in each of said categories, and thereby discern particular areas of weakness in said users golf swing:

b. practicing striking golf balls at a common target from a generally fixed location, comprising the further steps of:

i. striking a first golf ball at a target area having a target point;

ii. discerning the end location of said struck first golf ball relative to said target point;

iii. visualizing said target point as said golf hole on said diagrammatical layout of said markable substrate, marking on said markable substrate the approximate location of said first golf ball relative to said target point;

iv. striking another golf ball at said target area;

v. discerning the end location of said other struck golf ball relative to said target point;

vi. visualizing said target point as said golf hole on said diagrammatical layout of said markable substrate, marking on said markable substrate the approximate location of said other golf ball relative to said target point;

vii. repeating steps iv–vi until the desired amount practice has been achieved, generating various marks on said diagrammatical layout of said markable substrate;

c. reviewing the various marks generated during step i–iv on said markable substrate, determining the positions of said various marks relative to said golf hole and the locations of said various marks relative to said target area of said diagrammatical layout;

d. inscribing on said statistical tabulation markable substrate the number of shots within a target area, defining the number of good shots, and the number of shots outside of the target area, defining the number of poor shots;

e. calculating the percentage of good shots versus poor shots;

f. discerning the locations of said poor shots relative to the target area, determining a poor shot pattern;

g. utilizing said poor shot pattern to adjust said user's golf swing, thereby improving upon said user's golf swing, comprising the sub-step of referring to said critical fundamental golfing instructions in conjunction with said poor shot pattern, in order to diagnose a weakness in said user's golf swing, and thereby adjust said user's golf swing.

8. The method of claim 7, wherein there is further provided in step "f" the additional step of breaking down said poor, shot pattern into locational categories, and indicating on said statistical tabulation markable substrate the number of poor shots in each of said categories.

9. The method of claim 7, wherein in step "f" there is provided the additional step of providing critical fundamental golfing instructions associated with said markable substrate.

10. Golf practicing aid means for aiding a user in developing a golf swing, comprising:

a markable substrate depicting a diagrammatical layout of a golf hole graphically depicted thereon, on which substrate a user can mark the locations of a series of repeated, like practice golf shots from a generally fixed location, with reference to a target area graphically depicted thereon, providing golf shot indicia, said golf practicing aid means further comprising a statistical tabulation means for analyzing said golf shot indicia, discerning the location of at least some of said golf shots and discerning the number of golf shots within said target area and the number of golf shots outside of said target area, as well as the relative location of said golf shots relative to said target area, said statistical tabulation means further including analyzation means for discerning patterns relative to the location of said golf shots relative to said target area, providing the categorizing at least some of said golf shots based upon the relative location of said golf shots, in order to discern particular areas of weakness in said users golf swing, comprising the sub-step of consulting a database of critical fundamental golfing instructions, discerning the appropriate golfing instruction of pertinence to said poor shot pattern, and communicating said appropriate golfing instruction, in order to assist said user to adjust said user's golf swing.

11. The golf practicing aid means of claim 10 further characterized in that said markable substrate comprises a computer display.

12. The golf practicing aid means of claim 11 further characterized in that said computer display is a component of a computer, and said computer display is in the form of a touch sensitive screen.

13. The golf practicing aid means of claim 12 further characterized in that said statistical tabulation means is accomplished via a microprocessor driven program.

14. The golf practicing aid means of claim 10 further characterized in that said markable substrate is further defined as depicting a target area comprising a rectangular area having a specific target point therein and a circular area superimposed thereon representing a green whereby the specific target point represents a pin so that the user can record either practice fairway shots or green shots.

15. The golf practicing aid means of claim 12 further characterized in that said statistical tabulation means further includes input means for inputting pertinent information selected from the group consisting of the date, location, weather, wind direction, club type, yards to primary target, and surface type by said user, said statistical tabulation means considering said pertinent information in analyzing said golf shot indicia.

16. The method of aiding a user in developing a golf swing, comprising the steps of:

a. providing a computer having a visual display depicting a diagrammatical layout of a golf hole graphically depicted thereon, on which a user can mark practice golf shots with reference to a target area graphically depicted thereon;

b. practicing striking a plurality of golf balls utilizing generally the same type of club at a common target from a generally fixed location, comprising the further steps of:

i. striking a first golf ball at a target area having a target point;

ii. discerning the end location of said struck first golf ball relative to said target point;

iii. visualizing said target point as said golf hole on said visual display of said computer, inputting into said computer the approximate location of said first golf ball relative to said target point, as depicted on said visual display;

iv. striking another golf ball at said target area;

v. discerning the end location of said other struck golf ball relative to said target point;

vi. visualizing said target point as said golf hole on said visual display of said computer, inputting into said computer the approximate location of said other golf ball relative to said target point, as depicted on said visual display;

vii. repeating steps iv–vi until the desired amount practice has been achieved, generating golf ball location data of each ball relative to said target point, forming a database of ball location data entries for a practice session utilizing a common club, from a generally fixed location;

c. statistically analyzing said database to discern patterns in said golf ball location data, comprising the further steps of providing a database of golf instructional information including ball flight analysis, said database indexed according to the lie of a ball after a shot, and wherein there is further included after step "c" the additional step of utilizing said patterns in said golf location data to access instructional information on said database of golf instructional information, thereby improving upon said user's golf swing.

17. Sports practicing aid means for aiding a user in developing a technique for launching a projectile, comprising:

a markable substrate depicting a diagrammatical layout of a practice area graphically depicted thereon, on which substrate a user can mark multiple practice projectile shots from a generally fixed location with reference to a common target area graphically depicted thereon, providing projectile shot indicia, including grouping of said shots, as well as relative distances of said grouping and said shots to said target area, said sports practicing aid means further comprising a statistical tabulation means for analyzing said sports shot indicia, discerning the location of at least some of said projectile shots and discerning the number of projectile shots within said target area and the number of projectile shots outside of said target area, as well as the relative location of said projectile shots relative to said target area, said statistical tabulation means further including analyzation means for discerning patterns relative to the location of said projectile shots relative to said target area, providing the categorizing at least some of said projectile shots based upon the relative location of said projectile shots in relation to said target and in relation to said grouping of said shots, in order to discern particular area of weakness in said user projectile launching technique.

18. The method of aiding a user in launching a projectile, comprising the steps of:

a. providing a computer having a visual display depicting a diagrammatical layout of a practice area graphically depicted thereon, on which a user can mark practice projectile shot locations launched from a generally fixed location utilizing a common launching technique, with reference to a target area graphically depicted thereon;

b. practicing striking projectiles at a target launched from a generally fixed location utilizing a common launching technique, comprising the further steps of:

i. launching a first projectile at a target area having a target point;

ii. discerning the end location of said struck first projectile relative to said target point;

iii. visualizing said target point as said target area on said visual display of said computer, inputting into said computer the approximate location of said end location first projectile relative to said target point, as depicted on said visual display;

iv. launching another projectile at a said target area;

v. discerning the end location of said other launched projectile relative to said target point;

vi. visualizing said target point as said other launched projectile on said visual display of said computer, inputting into said computer the approximate location of said other launched projectile relative to said target point, as depicted on said visual display;

vii. repeating steps vi–vi until the desired amount practice has been achieved, generating projectile location data of each projectile relative to said target point, forming a database of projectile location data entries for a practice launched from a generally fixed location untilizing a common launching technique to a common target point;

c. statistically analyzing said database to discern patterns in said projectile location data, comprising the additional step of utilizing said patterns in said projectile location data to access and select for display certain instructional information on said database of instructional information, thereby improving upon said user's projectile launching technique.

19. The method of claim 18, wherein there is included after step "c" the additional step of providing a database of instructional information including projectile flight analysis, said database indexed according to the lie of a projectile after a launch.

* * * * *